US010281859B2

(12) United States Patent
Koide

(10) Patent No.: US 10,281,859 B2
(45) Date of Patent: May 7, 2019

(54) IMAGE FORMING APPARATUS

(71) Applicant: FUJI XEROX CO., LTD., Tokyo (JP)

(72) Inventor: Hiroyuki Koide, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/665,966

(22) Filed: Aug. 1, 2017

(65) Prior Publication Data

US 2018/0275578 A1 Sep. 27, 2018

(30) Foreign Application Priority Data

Mar. 23, 2017 (JP) ..... 2017-058013

(51) Int. Cl.
*G03G 15/00* (2006.01)
*G03G 15/01* (2006.01)
*G03G 15/16* (2006.01)

(52) U.S. Cl.
CPC ..... *G03G 15/5054* (2013.01); *G03G 15/0136* (2013.01); *G03G 15/1665* (2013.01)

(58) Field of Classification Search
CPC ..... G03G 15/1665; G03G 15/5054
See application file for complete search history.

(56) References Cited

U.S. PATENT DOCUMENTS 4,062,631 A * 12/1977 Ichikawa ..... G03G 15/6532 271/308
5,485,248 A * 1/1996 Yano ..... G03G 15/0216 399/168
6,970,666 B2 11/2005 Takahashi et al.
2011/0293306 A1* 12/2011 Matsumoto ..... G03G 15/1605 399/66
2016/0259277 A1* 9/2016 Umeno ..... G03G 15/2028

FOREIGN PATENT DOCUMENTS

JP 2005-274623 A 10/2005
JP 2011-008301 A 1/2011

* cited by examiner

*Primary Examiner* — David M. Gray
*Assistant Examiner* — Michael A Harrison
(74) *Attorney, Agent, or Firm* — Sughrue Mion, PLLC

(57) ABSTRACT

An image forming apparatus includes a transport unit, an image bearing member, a transfer unit, and a detector. The transport unit transports a continuous recording medium. The image bearing member retains an image thereon. The transfer unit has a transfer member that is movable into and out of contact with the image bearing member and transports the recording medium by nipping the recording medium between the image bearing member and the transfer member. The transfer unit transfers the image on the image bearing member onto the recording medium. The detector detects an electrical resistance of the transfer member in a state where the transfer member is disposed at a noncontact position located away from the image bearing member.

13 Claims, 11 Drawing Sheets

FIG. 5A $$V_p = a \times R_s + b$$

FIG. 5B

| | | SHEET TYPE | | | |
|---|---|---|---|---|---|
| | | THIN PAPER | PLAIN PAPER | THICK PAPER | ULTRA-THICK PAPER |
| ENVIRONMENT | HH | $a=a_{11}/b=b_{11}$ | $a=a_{21}/b=b_{21}$ | $a=a_{31}/b=b_{31}$ | $a=a_{41}/b=b_{41}$ |
| | MM | $a=a_{12}/b=b_{12}$ | $a=a_{22}/b=b_{22}$ | $a=a_{32}/b=b_{32}$ | $a=a_{42}/b=b_{42}$ |
| | LL | $a=a_{13}/b=b_{13}$ | $a=a_{23}/b=b_{23}$ | $a=a_{33}/b=b_{33}$ | $a=a_{43}/b=b_{43}$ |

| | (1) MM ENVIRONMENT | (2) HH ENVIRONMENT | (3) MM ENVIRONMENT | (4) LL ENVIRONMENT | (5) MM ENVIRONMENT |
|---|---|---|---|---|---|
| EXAMPLE 1 | ○ | ○ | ○ | ○ | ○ |
| COMPARATIVE EXAMPLE 1 | ○ | ○ | △ | × | × |

IMAGE FORMING APPARATUS

CROSS-REFERENCE TO RELATED APPLICATIONS

This application is based on and claims priority under 35 USC 119 from Japanese Patent Application No. 2017-058013 filed Mar. 23, 2017.

BACKGROUND

Technical Field

The present invention relates to image forming apparatuses.

SUMMARY

According to an aspect of the invention, there is provided an image forming apparatus including a transport unit, an image bearing member, a transfer unit, and a detector. The transport unit transports a continuous recording medium. The image bearing member retains an image thereon. The transfer unit has a transfer member that is movable into and out of contact with the image bearing member and transports the recording medium by nipping the recording medium between the image bearing member and the transfer member. The transfer unit transfers the image on the image bearing member onto the recording medium. The detector detects an electrical resistance of the transfer member in a state where the transfer member is disposed at a noncontact position located away from the image bearing member.

BRIEF DESCRIPTION OF THE DRAWINGS

Exemplary embodiments of the present invention will be described in detail based on the following figures, wherein:

FIG. 5A illustrates an example of a mathematical expression used when a transfer bias is to be determined in the flowchart in FIGS. 4A and 4B, and FIG. 5B illustrates an example of coefficients a and b in the mathematical expression shown in FIG. 5A;

DETAILED DESCRIPTION

Embodiments

Figure 1A:
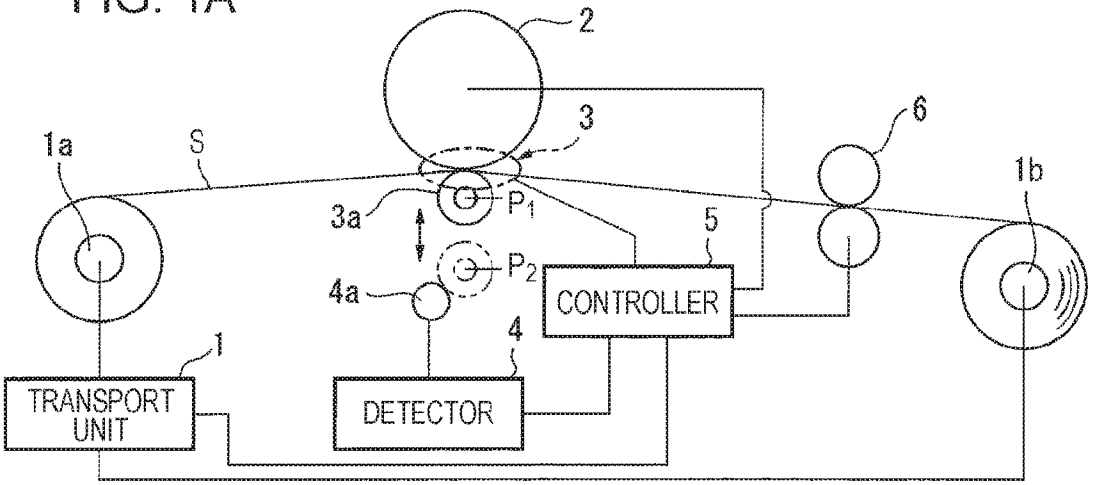
FIG. 1A schematically illustrates an image forming apparatus according to an exemplary embodiment of the present invention, FIG. 1B schematically illustrates an operational example during a process for detecting the resistance of a transfer unit, and FIG. 1C schematically illustrates an operational example at the start of an image forming process.

FIG. 1A schematically illustrates an image forming apparatus according to an exemplary embodiment of the present invention.

In FIG. 1A, the image forming apparatus includes a transport unit 1, an image bearing member 2, a transfer unit 3, a detector 4, and a controller 5. The transport unit 1 transports a continuous recording medium S. The image bearing member 2 retains an image thereon. The transfer unit 3 has a transfer member 3*a* capable of moving into and out of contact with the image bearing member 2. The transfer unit 3 transports the recording medium S by nipping the recording medium S between the image bearing member 2 and the transfer member 3*a* and transfers the image on the image bearing member 2 onto the recording medium S. The detector 4 detects an electrical resistance Rs of the transfer member 3*a* in a state where the transfer member 3*a* is disposed at a noncontact position $P_2$ located away from the image bearing member 2. The controller 5 determines a transfer condition of the transfer unit 3 from the detection result obtained by the detector 4 and controls an image forming operation performed on the recording medium S. In FIG. 1A, reference sign $P_1$ denotes a contact position where the transfer member 3*a* is in contact with the image bearing member 2 with the recording medium S interposed therebetween.

In such a technical configuration, the transport unit 1 may have a feeder 1*a* that feeds the recording medium S, a collector 1*b* that collects the recording medium S, and transport members (such as a transport roller and a transport belt) (not shown) that transport the recording medium S along a predetermined transport path.

The image bearing member 2 may be of any type, such as a drum type or a belt type, and may be an image formation photoconductor or a dielectric member alone or may include an intermediate transfer member.

The transfer unit 3 may be of any type appropriately selected from among various types so long as the selected type has a contactable-noncontactable transfer member 3*a* that transports the recording medium S by nipping the recording medium S in cooperation with the image bearing member 2 and transfers the image on the image bearing member 2 while transporting the recording medium S.

The detector 4 may be of any type that detects the electrical resistance Rs of the transfer member 3*a* in a separated state at least from the electrical resistance of the image bearing member 2. In this case, the transfer member 3*a* may be in a stopped state or in a rotating state. When the electrical resistance is to be detected by the detector 4, the image bearing member 2 and the recording medium S do not necessarily have to be stopped. For example, an image-quality-adjustment image may be formed while moving the image bearing member 2, and an image-quality adjustment process may be performed concurrently by reading the image.

The controller 5 may be of any type that ascertains the electrical resistance Rs of the transfer member 3*a* from the detection result obtained by the detector 4, determines the transfer condition of the transfer unit 3, including the electrical resistance Rs, in accordance with a predetermined algorithm, and controls the image forming operation performed on the recording medium S based on the determined transfer condition.

Figure 1C:
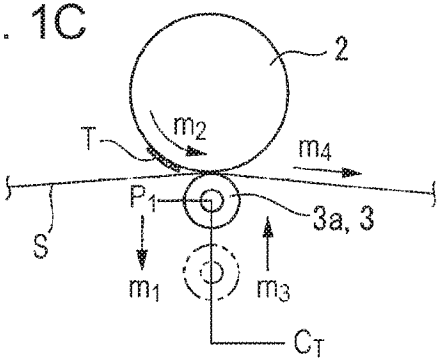
Figure 1B:
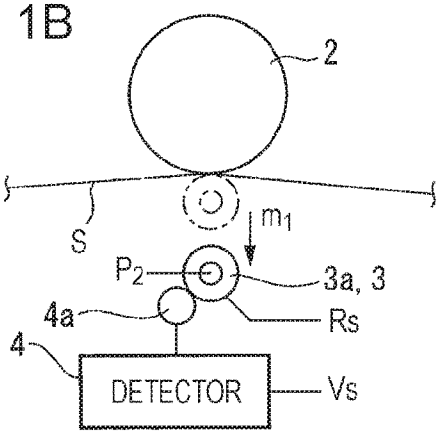

When a resistance condition of the transfer unit 3 is to be detected in the image forming apparatus according to this exemplary embodiment, the electrical resistance Rs of the transfer member 3*a* is detected by the detector 4 in a state where the transfer member 3*a* is disposed at the noncontact position $P_2$ relative to the image bearing member 2, as indicated by $m_1$ in FIG. 1B. In this state, the detected resistance condition of the transfer unit 3 corresponds to the electrical resistance Rs of the transfer member 3*a* separated at least from the image bearing member 2 and is a resistance value affected by the usage history or the environmental condition of the transfer member 3*a*. Therefore, the controller 5 calculates and determines a transfer condition necessary for the transfer unit 3, such as a transfer voltage necessary for obtaining a desired transfer current, based on the detection result obtained by the detector 4 (i.e., the electrical resistance Rs of the transfer member 3*a*).

In particular, in this example, the electrical resistance Rs of the transfer member 3*a* is accurately detectable in a state where the transfer member 3*a* is separated at least from the image bearing member 2. Therefore, in a case where the electrical resistance Rs of the transfer member 3*a* as the transfer condition of the transfer unit 3 has a large effect (e.g., in a case where the electrical resistance Rs of the transfer member 3*a* tends to be environmentally variable as compared with the recording medium S and the image bearing member 2), the example is effective for accurately calculating the transfer condition of the transfer unit 3.

Moreover, in addition to the electrical resistance Rs of the transfer member 3*a*, the electrical resistances of the recording medium S and the image bearing member 2 also have an effect as the transfer condition of the transfer unit 3. Therefore, in this example, it is desirable that the calculation be performed also in view of the electrical resistances of the recording medium S and the image bearing member 2 in addition to the electrical resistance Rs of the transfer member 3*a*.

Furthermore, in this example, because the transfer member 3*a* is at least not in contact with the image bearing member 2 during the process for detecting the electrical resistance Rs of the transfer member 3*a*, the image bearing member 2 does not necessarily have to be in a stopped state.

However, if there is a request for not transporting the recording medium S until the transfer condition of the transfer unit 3 is determined, the transport unit 1 may be stopped. Moreover, with regard to the image bearing member 2, if there is a request for, for example, executing an image-quality adjustment process in the image forming operation together with the process for determining the transfer condition of the transfer unit 3, the image bearing member 2 may be operated without being stopped. In this case, it is desirable that the image bearing member 2 be disposed away also from the recording medium S, and the image bearing member 2 may be operated in a state where the transport unit 1 is stopped.

When the transfer condition of the transfer unit 3 is determined in this manner, the controller 5 commences a sequential image forming operation.

When an image forming operation is to be started after a transfer condition $C_T$ of the transfer unit 3 is determined, the controller 5 causes the transfer member 3*a* to temporarily retract to the noncontact position $P_2$, as indicated by $m_1$ in FIG. 1C. Subsequently, the controller 5 causes the image bearing member 2 to retain an image T thereon by causing the image bearing member 2 to rotate, as indicated by $m_2$ in FIG. 1C. When the image T on the image bearing member 2 reaches a position in front of a transfer region, the transfer member 3*a* is moved to a transfer position (corresponding to a contact position $P_1$) where the recording medium S is nipped between the transfer member 3*a* and the image bearing member 2, as indicated by $m_3$ in FIG. 1C. Then, as indicated by $m_4$ in FIG. 1C, the recording medium S is transported by being nipped between the transfer member 3*a* and the image bearing member 2. When the image T on the image bearing member 2 reaches the transfer region, a transfer operation may be executed in accordance with the determined transfer condition $C_T$, so that the image T is transferred onto the recording medium S. This example is a desired example of control of an image forming operation after the transfer condition $C_T$ of the transfer unit 3 is determined. In this example, the contact-noncontact timings of the transfer member 3*a* are adjusted so that the recording medium S is transported in correspondence with the transfer operation of the image T, thereby eliminating wasteful transportation of the recording medium S.

Next, representative examples of the image forming apparatus according to this exemplary embodiment will be described.

As one example of this exemplary embodiment, the transfer member 3*a* is out of contact with the recording medium S at the noncontact position $P_2$. In a configuration in which the transfer member 3*a* is in contact with the recording medium S at the noncontact position $P_2$, there is a risk of a portion of detection current leaking from the recording medium S when the detector 4 detects the resistance of the transfer member 3*a*. However, because the contact state between the transfer member 3*a* and the recording medium S is unstable as compared with a configuration in which the recording medium S is nipped between the image bearing member 2 and the transfer member 3*a*, the amount of leakage of the detection current is small. In contrast, in this example, the accuracy of detection of the electrical resistance Rs of the transfer member 3*a* by the detector 4 may be more favorably maintained since there is no leakage of the detection current.

Furthermore, as another example of this exemplary embodiment, the electrical resistance Rs of the transfer member 3*a* has an environmentally-dependent rate of change higher than those of the electrical resistances of the image bearing member 2 and the recording medium S included in the transfer unit 3, as described above. Because this example uses a transfer member 3*a* with a high environmentally-dependent rate of change of electrical resistance Rs, the transfer condition $C_T$ of the transfer unit 3 may be determined by detecting a change in the electrical resistance Rs of the transfer member 3*a*, which has a large effect in the transfer condition $C_T$ of the transfer unit 3. Needless to say, for determining the transfer condition $C_T$ of the transfer unit 3 more accurately, the initial values of the electrical resistances of the recording medium S and the image bearing member 2 and the amount of change occurring with an environmental change may be taken into consideration.

As one example of the detector 4, the detector 4 detects the electrical resistance Rs of the transfer member 3*a* while the transport unit 1 is in a stopped state. In this example, the transport unit 1 is stopped when the electrical resistance of the transfer member 3*a* is to be detected, thereby preventing wasteful transportation of the recording medium S.

Furthermore, referring to FIGS. 1A and 1B, as a representative example of the detector 4, the detector 4 includes an electrode member 4*a* disposed in contact with the transfer member 3*a* when the electrical resistance of the transfer member 3*a* is to be detected and capable of applying a voltage Vs for detecting the electrical resistance of the transfer member 3*a*. In this example, the transfer member 3*a* comes into contact with the electrode member 4*a* when the transfer member 3*a* is disposed at the noncontact position $P_2$ where the electrical-resistance-detection voltage Vs is applied to the transfer member 3*a*, so that the electrical resistance Rs of the transfer member 3*a* is detected.

As one example of the detector 4 of this type, the electrical resistance Rs of the transfer member 3*a* is continuously detected while the transfer member 3*a* disposed in contact with the electrode member 4*a* makes at least one rotation. In this example, the transfer member 3*a* is disposed in contact with the electrode member 4*a* and the electrical resistance Rs of the transfer member 3*a* is continuously detected while the transfer member 3*a* makes at least one rotation, so that a change in the electrical resistance Rs in the circumferential direction of the transfer member 3*a* may be ascertained.

As one example, the electrode member 4*a* of the detector 4 of this type may be a rotatable roller. In this example, when the electrical resistance Rs of the transfer member 3*a* is to be detected while the transfer member 3*a* disposed in contact with the electrode member 4*a* is rotated, the frictional resistance between the transfer member 3*a* and the electrode member 4*a* in contact with each other may be reduced so that the operation for detecting the electrical resistance may be executed smoothly.

Furthermore, the electrode member 4*a* of this type may also function as a cleaning member.

In this case, the electrode member 4*a* may also function as a cleaning member that applies a predetermined cleaning voltage so as to electrostatically attract foreign matter adhered on the surface of the transfer member 3*a*. In this example, the electrode member 4*a* also functions as a cleaning member in addition to the original functional member and applies a cleaning voltage to clean off foreign matter, such as image formation particles, on the surface of the transfer member 3*a* by electrostatic attraction using an electrostatic attraction force generated by the cleaning voltage. The "cleaning voltage" in this case may be the electrical-resistance-detection voltage Vs or may be another voltage.

As an example in which the electrode member 4*a* functions as a cleaning member, the electrode member 4*a* may include a cleaning member that scrapes off foreign matter therefrom. In this example, the foreign matter adhered on the electrode member 4*a* is scraped off therefrom so that a change in resistance caused by the foreign matter adhered on the electrode member 4*a* is suppressed, thereby eliminating a disturbance factor when the electrical resistance Rs of the transfer member 3*a* is to be detected.

Furthermore, as another example in which the electrode member 4*a* functions as a cleaning member, the electrode member 4*a* may include a cleaning-voltage power source capable of alternately applying cleaning voltages with different polarities to the electrode member 4*a* every time the transfer member 3*a* makes one rotation. This example uses the cleaning-voltage power source to switch between the polarities of the cleaning voltages so as to clean off foreign matter, such as image formation particles, having a different polarity and adhered on the electrode member 4*a*.

The detector 4 has to have a voltage power source for detecting the electrical resistance. In view of simplifying the configuration of the detector 4, the transfer unit 3 has a transfer power source capable of applying a transfer voltage to the transfer member 3*a* as a voltage power source for detecting the electrical resistance. Therefore, when detecting the electrical resistance of the transfer member 3*a*, the detector 4 may apply the electrical-resistance-detection voltage Vs to the transfer member 3*a* by using the aforementioned transfer power source.

Exemplary embodiments of the present invention will be described below in further detail with reference to the appended drawings.

First Exemplary Embodiment

Overall Configuration of Image Forming Apparatus

Figure 2:
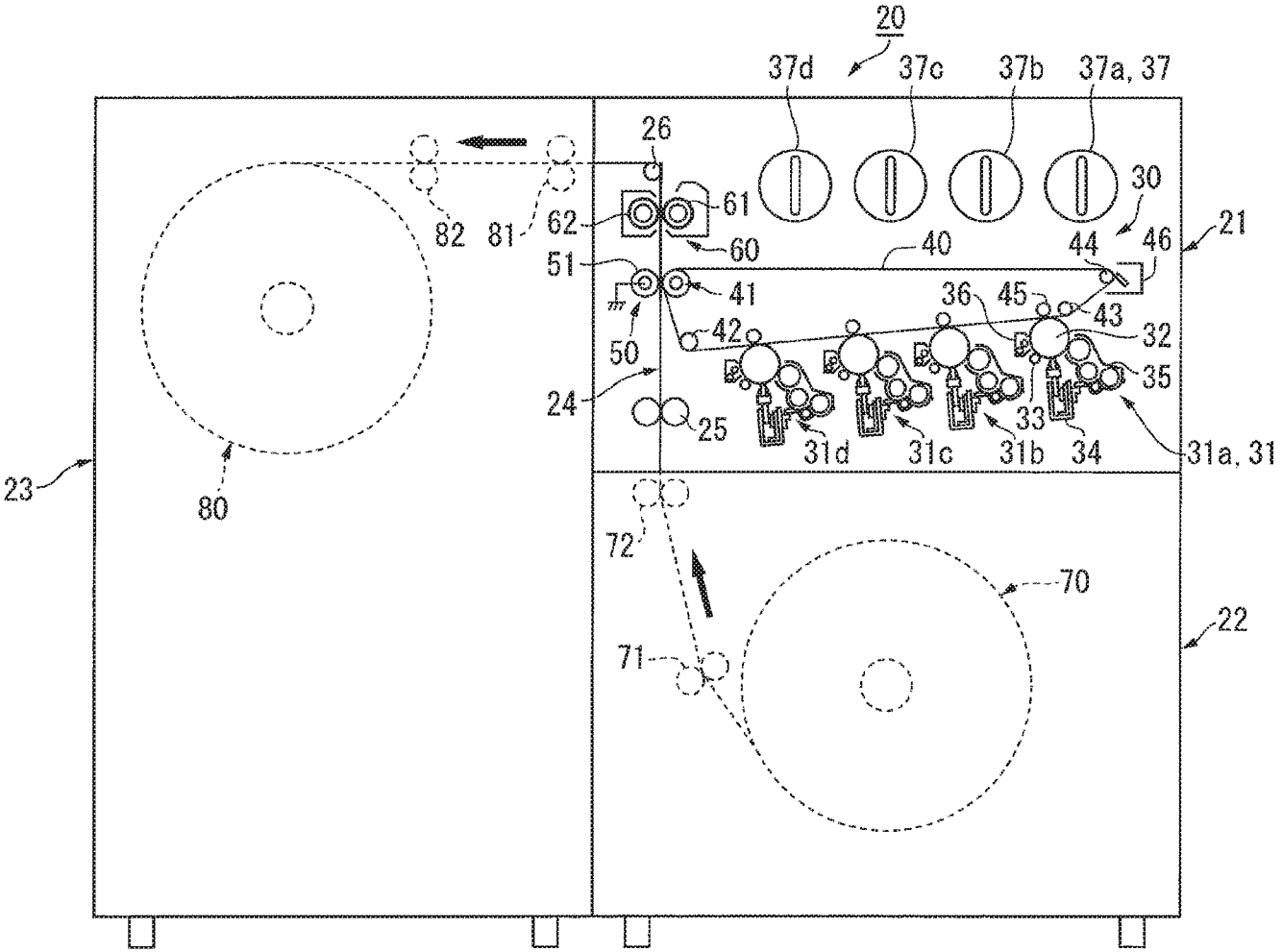
FIG. 2 illustrates the overall configuration of an image forming apparatus according to a first exemplary embodiment.

FIG. 2 illustrates the overall configuration of an image forming apparatus according to a first exemplary embodiment.

In FIG. 2, an image forming apparatus 20 forms an image onto a continuous recording medium (referred to as "continuous sheet" hereinafter) S and includes an image forming unit 21 containing an image forming engine 30 therein as an image forming unit, a feeding unit 22 that is disposed below the image forming unit 21 and that feeds the continuous sheet S to the image forming unit 21, and a collecting unit 23 that is disposed laterally adjacent to the image forming unit 21 and the feeding unit 22 and that collects the continuous sheet S discharged from the image forming unit 21.

Image Forming Engine

In this exemplary embodiment, the image forming engine 30 includes image forming sections 31 (i.e., 31*a* to 31*d*) that form multiple (four in this example) color component images, a belt-shaped intermediate transfer member 40 onto which the images formed at the image forming sections 31 are first-transferred before the images are transferred onto the continuous sheet S, and a second-transfer device 50 that collectively transfers (second-transfers) the images first-transferred on the intermediate transfer member 40 onto the continuous sheet S.

In this example, each of the image forming sections 31 employs, for example, the electrophotographic method and includes a drum-shaped photoconductor 32 having a photosensitive layer formed on, for example, the peripheral surface thereof, a charging device 33, such as a charging roller, for electrostatically charging the photoconductor 32, a latent-image writing device 34 that is formed of, for example, a light-emitting diode (LED) array and that writes an electrostatic latent image onto the photoconductor 32 electrostatically charged by the charging device 33, a developing device 35 that develops the electrostatic latent image written on the photoconductor 32 by the latent-image writing device 34 into a visible image by using a developer containing a color component toner, and a cleaning unit 36 that cleans off residual toner remaining on the photoconductor 32 after the toner is used by the developing device 35 for obtaining the visible image. The electrophotographic device used in this example may be of a commonly-known type. For example, a laser scanning device may be used as the latent-image writing device 34 in place of the LED array. Moreover, each image forming section 31 is of a type that employs the electrophotographic method but is not limited to this type. For example, an electrostatic recording system that uses a dielectric member in place of the photoconductor 32 and that forms an electrostatic latent image by using an ion head may be appropriately selected. Each reference sign 37 (i.e., 37*a* to 37*d*) denotes a toner cartridge for supplying a color component toner to the corresponding developing device 35.

In this example, the intermediate transfer member 40 is extended around multiple tension rollers 41 to 44. For example, the tension roller 41 as a driving roller and the tension roller 44 as a tension applying roller are rotated. In the intermediate transfer member 40, regions facing the photoconductors 32 of the respective image forming sections 31 are provided with first-transfer devices 45, such as first-transfer rollers, such that the images on the photoconductors 32 are first-transferred onto the intermediate transfer member 40.

Furthermore, in the intermediate transfer member 40, a downstream region (i.e., a region facing the tension roller 44 in this example) relative to a second-transfer region in the rotational direction is provided with an intermediate-transfer-member cleaning device 46 that cleans off the residual toner remaining on the intermediate transfer member 40.

Moreover, as shown in FIG. 2, the second-transfer device 50 has a second-transfer roller 51 that is located in a region of the intermediate transfer member 40 that faces the tension roller 41 and that is rotationally slave-driven by the intermediate transfer member 40. The second-transfer device 50 nips and transports the continuous sheet S in cooperation with the intermediate transfer member 40 and forms a second-transfer electric field by using the tension roller 41 as a counter-electrode, thereby collectively transferring the multiple-layered images on the intermediate transfer member 40 onto the continuous sheet S.

Furthermore, in this exemplary embodiment, a transport path 24 for the continuous sheet S extends substantially in the vertical direction within the image forming unit 21. In the transport path 24, a registration roller 25 for registration of the images on the intermediate transfer member 40 is disposed upstream of the second-transfer device 50 in the transport direction of the continuous sheet S. Moreover, in the transport path 24, a fixing device 60 where the images formed in the image forming engine 30 are fixed is disposed downstream of the second-transfer device 50 in the transport direction of the continuous sheet S. Reference sign 26 denotes a guide roller that guides the continuous sheet S passing through the fixing device 60 toward the collecting unit 23.

Furthermore, in this example, the fixing device 60 has a rotationally-driven thermal fixing roller 61 having a built-in heater and a pressure fixing roller 62 that is rotationally slave-driven by being disposed in pressure contact with the thermal fixing roller 61. By causing the continuous sheet S to travel between the fixing rollers 61 and 62, the unfixed image on the continuous sheet S is fixed thereto with heat and pressure. The fixing device 60 is not limited to this type and may use, for example, belt members as fixing members in place of the roller members, or may use a noncontact flash fixing method or laser fixing method.

In this exemplary embodiment, the feeding unit 22 has an unwinding roller 70, as a continuous-sheet feeder, around which the continuous sheet S is wound into a shape of a roller and that unwinds the continuous sheet S by being rotated by a driving source (not shown). The unwound continuous sheet S is transported by multiple pairs of transport rollers 71 and 72 and is fed into the image forming unit 21.

The collecting unit 23 has a winding roller 80, as a continuous-sheet collector, around which the continuous sheet S is wound into a shape of a roller and that winds up the continuous sheet S by being rotated by a driving source (not shown). The continuous sheet S discharged from the image forming unit 21 is transported by multiple pairs of transport rollers 81 and 82 and is collected by being wound around the winding roller 80.

Example of Configuration Surrounding Second-Transfer Device and Fixing Device

Figure 3:
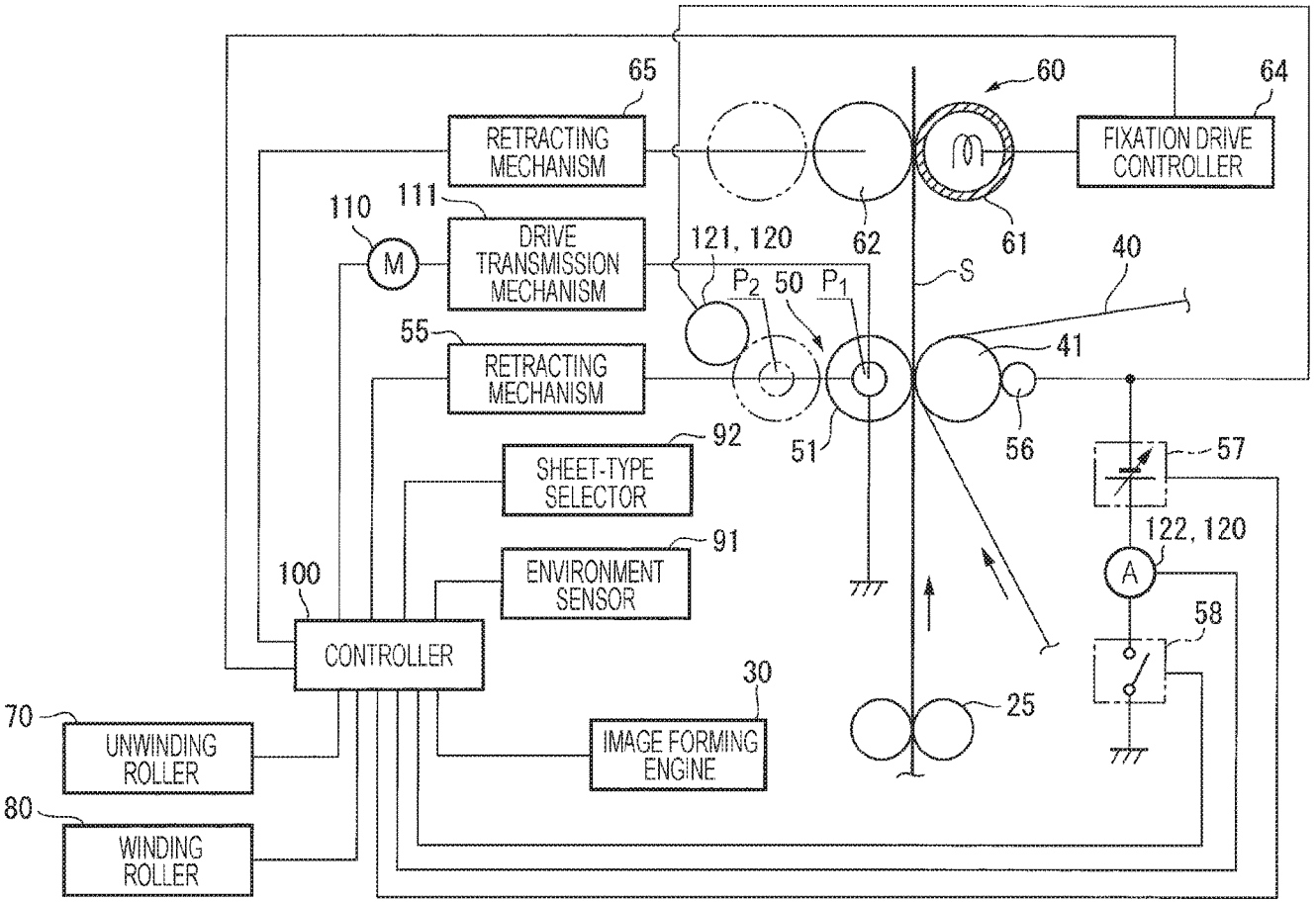
FIG. 3 illustrates the configuration surrounding a transfer unit and a fixing unit according to the first exemplary embodiment and a control system therefor.

As shown in FIG. 3, in this exemplary embodiment, the second-transfer device 50 uses a retracting mechanism 55 to move the second-transfer roller 51 between the contact position $P_1$, at which the second-transfer roller 51 comes into contact with the continuous sheet S, and a retract position $P_2$ as a noncontact position located away from the contact position $P_1$. Moreover, the second-transfer device 50 transmits a driving force from a driving motor 110 to the second-transfer roller 51 via a drive transmission mechanism 111, such as a gear train, so as to rotate the second-transfer roller 51.

In this example, the second-transfer roller 51 is formed by wrapping semi-conductive foamed rubber, such as foamed rubber (composed of, for example, nitrile rubber(NBR), urethane, epichlorohydrin, or ethylene-propylene-diene methylene linkage (EPDM)) having a conducting agent, such as carbon black or an ionic conducting agent, mixed therein around a metallic (e.g., steel) core. The second-transfer roller 51 has an electrical resistance (volume resistivity) of 6 to 10 log Ω, and the metallic core is connected to ground.

The tension roller 41 of the intermediate transfer member 40 functions as a counter-electrode (backup roller) for the second-transfer roller 51. In this example, the tension roller 41 receives a transfer bias (corresponding to a transfer voltage) Vp from a high-voltage power source 57 via a power feed roller 56. In this example, the tension roller 41 is formed by wrapping conductive solid rubber around a round-rod-shaped core composed of steel and has an electrical resistance (volume resistivity) of 3 to 6 log Ω.

As output control of the high-voltage power source 57, either constant voltage control or constant current control may be used. In this example, a power supply circuit of constant voltage control is used. Reference sign 58 denotes a power feed switch for applying the transfer bias Vp.

Furthermore, in this exemplary embodiment, the thermal fixing roller 61 of the fixing device 60 is connected to the built-in heater and to a fixation drive controller 64 for adjusting the rotation of the thermal fixing roller 61. Moreover, the pressure fixing roller 62 is moved into and out of contact with the thermal fixing roller 61 by a retracting mechanism 65.

Resistance Detection Example of Second-Transfer Device

In this exemplary embodiment, a detector 120 that detects the electrical resistance of the second-transfer roller 51 is provided. The detector 120 used in this example has an electrode roller 121 with which the second-transfer roller 51 comes into contact when the second-transfer roller 51 moves to the retract position $P_2$ located away from the intermediate transfer member 40. In this example, the electrode roller 121 is formed of a round-rod-shaped steel member and is not coated with, for example, rubber. The electrode roller 121 is connected to the aforementioned high-voltage power source 57 so as to have the same electric potential as the tension roller (backup roller) 41. When the resistance of the second-transfer roller 51 is to be detected, the resistance-detection voltage Vs (in this example, a predetermined electric potential, such as −1 kV, different from the transfer bias Vp) is applied from the high-voltage power source 57. An ampere meter 122 is provided between the high-voltage power source 57 and the power feed switch 58. The ampere meter 122 is capable of measuring the electric current (i.e., transfer current or resistance-detection current) flowing through the respective closed circuits when the transfer bias Vp or the resistance-detection voltage Vs is applied from the high-voltage power source 57.

Control System

Figure 4A:
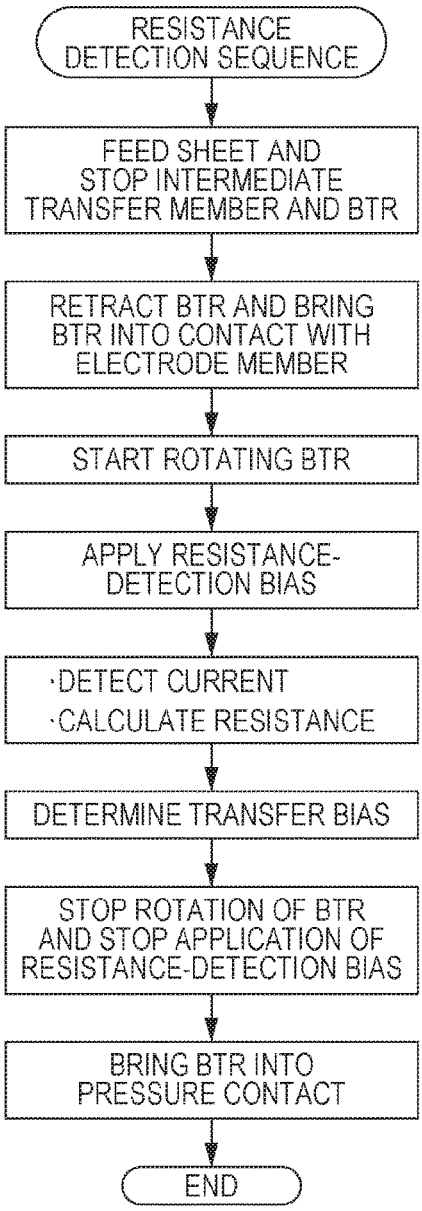
FIG. 4A is a flowchart illustrating a resistance detection sequence of a second-transfer region of the image forming apparatus according to the first exemplary embodiment.
Figure 4B:
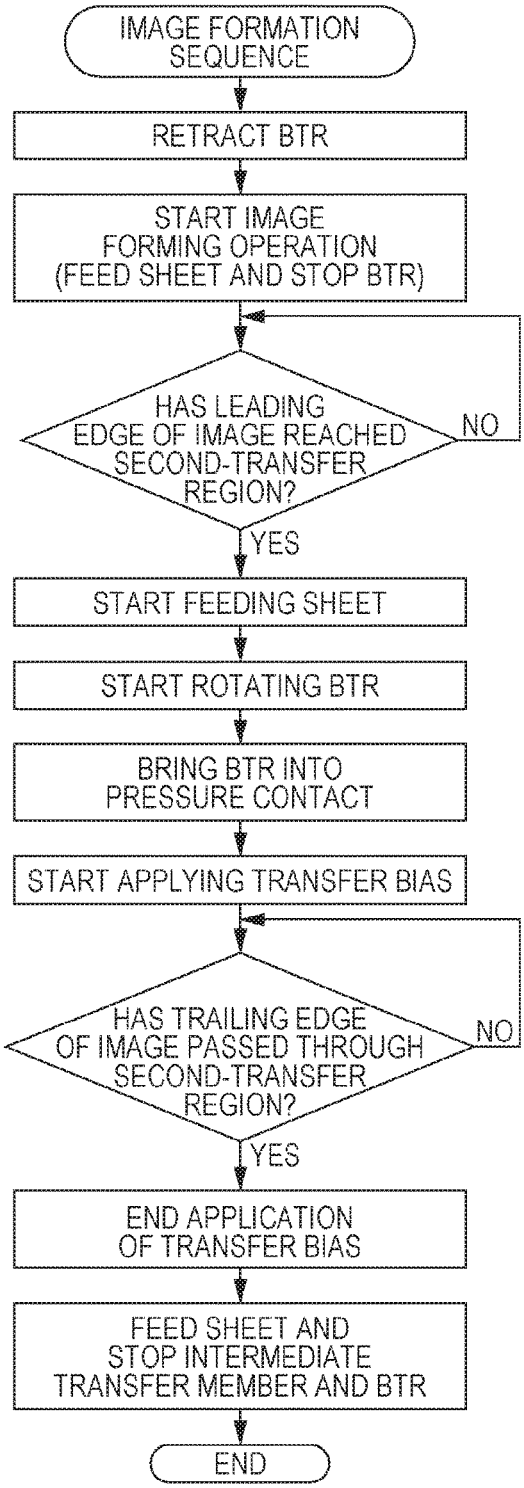
FIG. 4B is a flowchart illustrating an image formation sequence of the image forming apparatus.

Furthermore, a controller 100 is constituted of, for example, a microcomputer, receives a start signal (not shown) based on which an image forming operation of the image forming apparatus starts, an output signal from an environment sensor 91 that detects, for example, the temperature and humidity, a selection signal from a sheet-type selector 92 that selects the sheet type of the continuous sheet S, and an electric-current signal from the ampere meter 122, executes programs (e.g., a resistance detection program of the transfer unit and an image formation program shown in FIGS. 4A and 4B) preinstalled in a read-only memory (ROM), and transmits predetermined control signals to the image forming engine 30, the retracting mechanism 55 and the power feed switch 58 of the second-transfer device 50, the fixation drive controller 64 and the retracting mechanism 65 of the fixing device 60, the unwinding roller 70 as a continuous-sheet feeder, and the winding roller 80 as a continuous-sheet collector.

Operation of Image Forming Apparatus

Next, the operation of the image forming apparatus according to this exemplary embodiment will be described.

Resistance Detection Sequence of Second-Transfer Unit

In this exemplary embodiment, the resistance detection sequence of the second-transfer unit is normally executed before the start of a printing operation (image forming operation) (such as a warmup heating operation of the fixing device 60), after the start of the printing operation (image forming operation), or during the printing operation.

As shown in FIGS. 4A, 4B, 6A, and 6B, the resistance detection sequence of this type involves feeding the continuous sheet S, stopping rotation of both the intermediate transfer member 40 and the second-transfer roller 51 (indicated as BTR (abbreviation of "bias transfer roller") in FIGS. 4A and 4B), and causing the second-transfer roller 51 to retract from the contact position $P_1$ to the retract position $P_2$ by using the retracting mechanism 55, thereby bringing the second-transfer roller 51 into contact with the electrode roller 121 at the retract position $P_2$. Furthermore, in this example, after the second-transfer roller 51 is brought into contact with the electrode roller 121, the second-transfer roller 51 makes at least one rotation, and during that time, the electrode roller 121 is rotationally slave-driven.

When the power feed switch 58 is turned on in this state, the predetermined resistance-detection voltage Vs (e.g., −1 kV) is applied to the second-transfer roller 51 of the second-transfer device 50 and to the tension roller 41 by using the high-voltage power source 57.

In this case, since the second-transfer roller 51 is disposed out of contact with the intermediate transfer member 40 facing the tension roller 41, an open circuit is maintained between the high-voltage power source 57 and the tension roller 41, whereas the high-voltage power source 57, the electrode roller 121, and the second-transfer roller 51 form a closed circuit. Therefore, the ampere meter 122 connected in series to the high-voltage power source 57 continuously detects an electric current Is flowing through the aforementioned closed circuit while the second-transfer roller 51 makes at least one rotation. Because the second-transfer roller 51 is the most resisting element in the closed circuit, the electric current Is flowing through the ampere meter 122 changes by being mostly dependent on the electrical resistance Rs of the second-transfer roller 51. The controller 100 may calculate the electrical resistance Rs of the second-transfer roller 51 from the electric current Is detected by the ampere meter 122 by using the following expression (1).

$$Rs = Vs/Is \quad (1)$$

where Rs=1000 [V]÷50 [μA]=20 [MΩ], assuming that Is=50 [μA].

In particular, in this example, after the electric current Is is continuously detected while the second-transfer roller 51 makes at least one rotation, an average value of the electric current Is is calculated by sampling. Thus, the effect of uneven resistance on the peripheral surface of the second-transfer roller 51 may be reduced, as compared with a case where the resistance detection sequence is performed at a single location on the peripheral surface of the second-transfer roller 51.

Algorithm for Determining Transfer-Bias

Next, the controller 100 acquires an output of the temperature and humidity from the environment sensor 91 and determines the type of the surrounding environment. For example, the controller 100 determines whether the surrounding environment is a low-temperature low-humidity (LL) environment, a mid-temperature mid-humidity (MM) environment, or a high-temperature high-humidity (HH) environment.

Furthermore, the controller 100 acquires information about the sheet type selected by the sheet-type selector 92. For example, the controller 100 determines whether the sheet type is thin paper, plain paper, thick paper or ultra-thick paper.

Subsequently, for example, as shown in FIG. 5B, the controller 100 refers to control parameters a and b preliminarily stored in the ROM based on the combination of these pieces of information. These control parameters a and b change by being dependent on the sheet-type information and the environment information and are selected in advance based on tests in view of the resistance information of the intermediate transfer member 40, the tension roller 41, and the continuous sheet S.

After referring to the control parameters a and b, the controller 100 may substitute the electrical resistance Rs of the second-transfer unit and the referred control parameters a and b into a mathematical expression shown in FIG. 5A so as to determine the transfer bias Vp.

The mathematical expression shown in FIG. 5A is merely an example for calculating the transfer bias Vp, and another mathematical expression may be used as an alternative.

After determining the transfer bias Vp, the controller 100 stops the operation for rotating the second-transfer roller 51 and the operation for applying the resistance-detection voltage Vs, moves the second-transfer roller 51 into pressure contact with the continuous sheet S at the contact position $P_1$, and ends the resistance detection sequence.

Start of Image Forming Operation

When the transfer bias Vp is determined in this manner, the controller 100 starts an image formation sequence shown in FIG. 4B.

First, as shown in FIG. 4B, when an image forming operation is to be started, the second-transfer roller 51 is temporarily retracted from the contact position $P_1$ with the continuous sheet S, the continuous sheet S is fed, and the image forming operation is started by using the image forming sections 31 (i.e., 31*a* to 31*d*) of the image forming engine 30 and the intermediate transfer member 40 while the second-transfer roller 51 is maintained in a stopped state. In a case where the image formation sequence is to be started continuously from the resistance detection sequence, the image formation sequence may be started while keeping the second-transfer roller 51 retracted to the retract position $P_2$ without being returned to the contact position $P_1$, so as to reduce a waste of continuous sheet S.

In this case, color-component images are formed on the photoconductors 32 of the respective image forming sections 31 and are individually first-transferred onto the intermediate transfer member 40, but the continuous sheet S is maintained in a stopped state during this image forming operation.

Figure 6A:
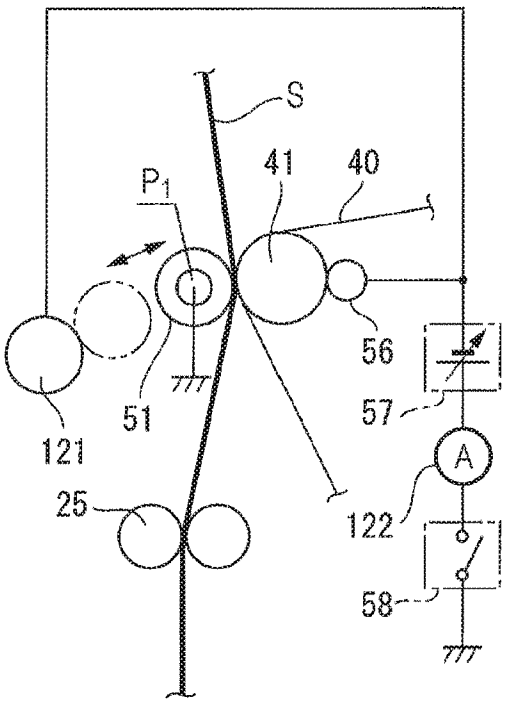
FIG. 6A illustrates a relevant part of the configuration surrounding the second-transfer region used in the first exemplary embodiment, FIG. 6B schematically illustrates the resistance detection sequence of the second-transfer region, and FIG. 6C schematically illustrates the image formation sequence after the resistance detection sequence of the second-transfer region.
Figure 6B:
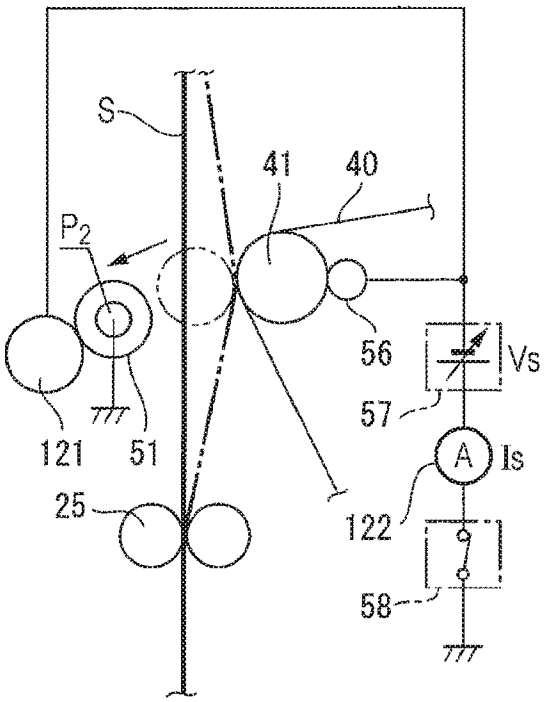
Figure 6C:
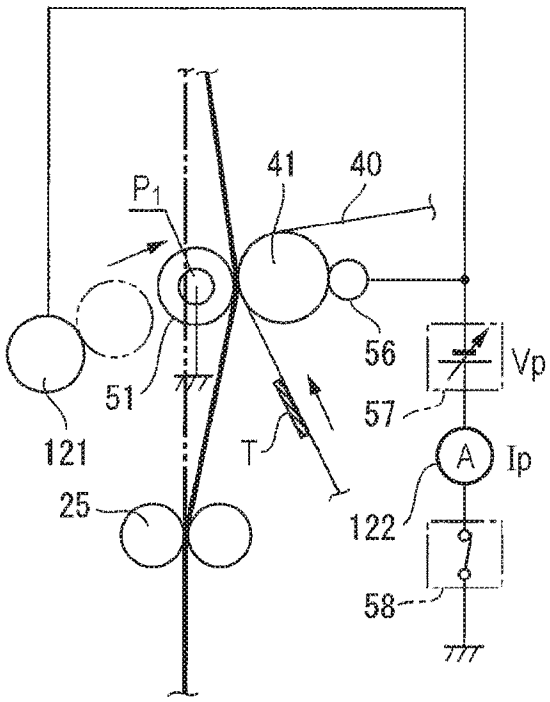

Subsequently, as shown in FIG. 6C, when the leading edge of the image T on the intermediate transfer member 40 reaches the second-transfer region (corresponding to a second-transferrable region as a contact region between the intermediate transfer member 40 and the continuous sheet S), the second-transfer roller 51 is rotated and is brought into pressure contact with the intermediate transfer member 40 so as to nip and transport the continuous sheet S in cooperation with the intermediate transfer member 40. Moreover, the second-transfer device 50 starts receiving the transfer bias Vp from the high-voltage power source 57. Although the transfer bias Vp is applied to the tension roller 41 and the electrode roller 121 in this state, the electrode roller 121 is disposed out of contact with the second-transfer roller 51 so that an open circuit is formed between the high-voltage power source 57 and the electrode roller 121. On the other hand, since the second-transfer roller 51 is disposed at the contact position $P_1$, the high-voltage power source 57, the tension roller 41, the intermediate transfer member 40, the continuous sheet S, and the second-transfer roller 51 form a closed circuit. A transfer current Ip according to the transfer bias Vp flows through the closed circuit, so that the image T on the intermediate transfer member 40 is transferred onto the continuous sheet S. During this time, a change in the transfer current Ip is monitored by the ampere meter 122 and is applied to transfer operation control.

Then, when the trailing edge of the image T on the intermediate transfer member 40 passes through the second-transfer region, the application of the transfer bias Vp to the second-transfer device 50 ends, and the second-transfer roller 51 temporarily retracts from the contact position $P_1$ with the continuous sheet S so as to stop rotating.

Therefore, in this exemplary embodiment, the transfer bias Vp is determined in view of the environment information, the sheet type of the continuous sheet S, and also the resistances of the intermediate transfer member 40 and the tension roller (backup roller) 41, based on the electrical resistance Rs of the second-transfer roller 51 detected in the aforementioned resistance detection sequence. Thus, in addition to the transfer operation of the image T being executed in an optimal transfer condition, the continuous sheet S moves together with the intermediate transfer member 40 while the image T on the intermediate transfer member 40 is being transferred onto the continuous sheet S. In contrast, the continuous sheet S is maintained in a stopped state when the transfer operation is not being executed, so that the continuous sheet S may be prevented from being wastefully transported to non-image-forming regions.

Furthermore, in this exemplary embodiment, the electrical resistance Rs of the second-transfer roller 51 is detectable without the intervention of the continuous sheet S in the resistance detection sequence of the second-transfer unit, so that even when a low-resistance continuous sheet S, such as gold or silver plated paper, black folding paper, or hydrous paper, is used, electric-current leakage through the continuous sheet S does not occur, thereby increasing the accuracy when determining the transfer bias Vp.

Furthermore, in this example, the thermal fixing roller 61 of the fixing device 60 is movable into and out of contact with the continuous sheet S by using the retracting mechanism 65 and is similar to the second-transfer device 50 in that the pair of fixation rollers 61 and 62 are disposed away from the continuous sheet S when the continuous sheet S is in a stopped state. Therefore, when the continuous sheet S is in a stopped state, there is a low possibility of thermal discoloration of the continuous sheet S positioned between the thermal fixing roller 61 and the pressure fixing roller 62 of the fixing device 60.

Second Exemplary Embodiment

Figure 7:
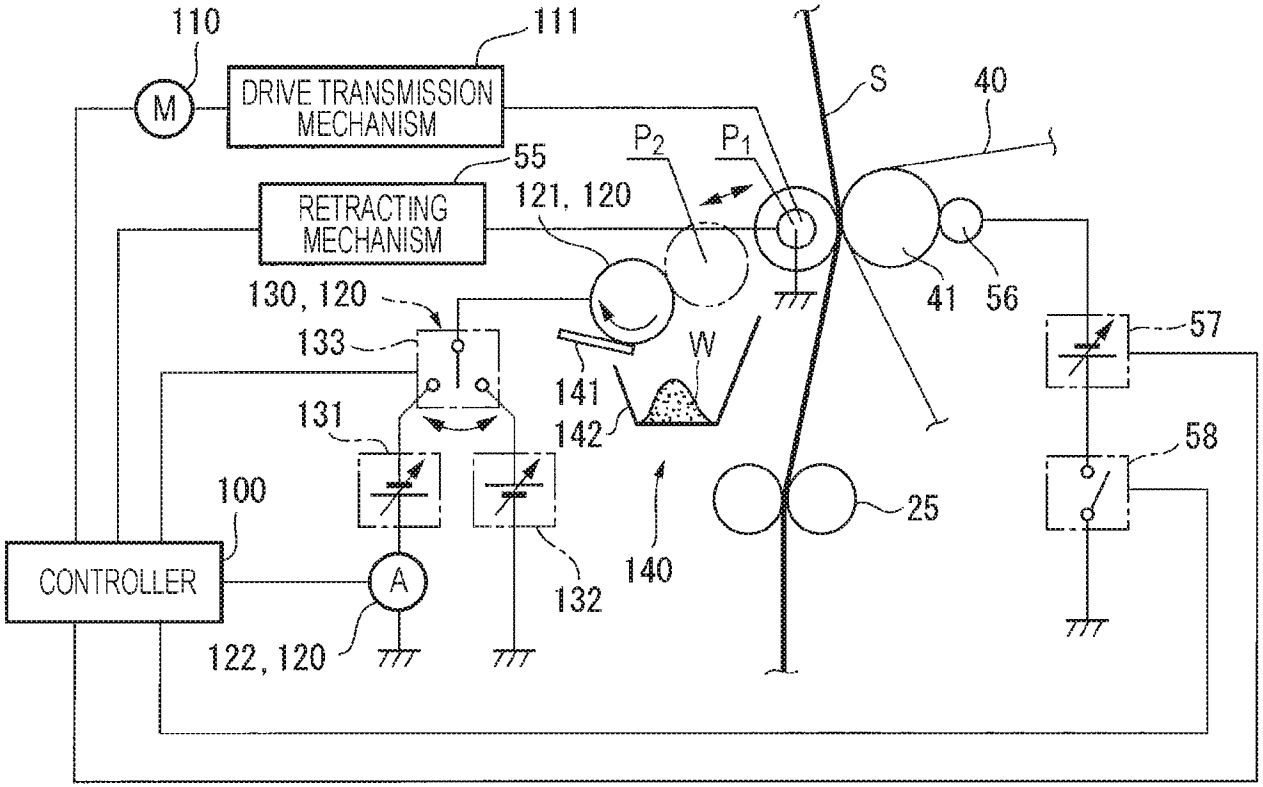
FIG. 7 illustrates a relevant part of the configuration surrounding a second-transfer region of an image forming apparatus according to a second exemplary embodiment.

FIG. 7 illustrates a control system and the configuration surrounding a second-transfer device, which is a relevant part of an image forming apparatus according to a second exemplary embodiment.

In FIG. 7, the components surrounding the second-transfer device 50 are substantially similar to those in the first exemplary embodiment in that the second-transfer roller 51 is movable between the contact position $P_1$ and the retract position $P_2$ by using the retracting mechanism 55, and in that the second-transfer roller 51 is rotationally drivable by using a driving mechanism (i.e., the driving motor 110 and the drive transmission mechanism 111). However, the second exemplary embodiment differs from the first exemplary embodiment in terms of the configuration of the detector 120 that detects the electrical resistance Rs of the second-transfer roller 51. Components similar to those in the first exemplary embodiment are given the same reference signs as in the first exemplary embodiment, and detailed descriptions thereof will be omitted.

In this example, the detector 120 is similar to that in the first exemplary embodiment in having the rotatable electrode roller 121 that comes into contact with the second-transfer roller 51 when the second-transfer roller 51 retracts to the retract position $P_2$, but differs from that in the first exemplary embodiment in terms of the configuration of a power supply unit 130 that applies the resistance-detection voltage Vs to the electrode roller 121.

In this example, the power supply unit 130 is provided separately from the high-voltage power source 57 that applies the transfer bias Vp, and includes a negative-polarity power source 131 that variably applies a negative-polarity bias, a positive-polarity power source 132 that variably applies a positive-polarity bias, and a switch 133 that switches between the power sources 131 and 132. The ampere meter 122, which is a component of the detector 120, is connected in series between the negative-polarity power source 131 and the ground.

In this example, in addition to being capable of applying the predetermined resistance-detection voltage Vs (e.g., −1 kV), the negative-polarity power source 131 is also capable of applying a predetermined negative-polarity cleaning bias Vc−(e.g., −0.5 kV) to be used in a cleaning cycle, which will be described later, for the second-transfer roller (BTR) 51. The positive-polarity power source 132 is capable of applying a predetermined positive-polarity cleaning bias Vc+ (e.g., +0.5 kV) to be used in the same cleaning cycle for the second-transfer roller 51.

Figure 8A:
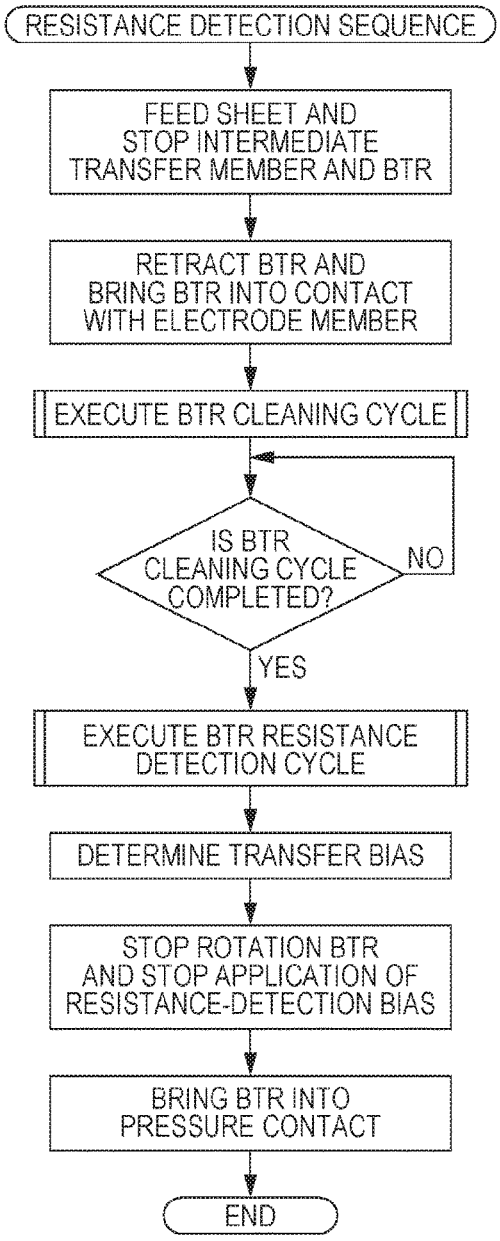
FIG. 8A is a flowchart illustrating the resistance detection sequence of the second-transfer region of the image forming apparatus according to the second exemplary embodiment.

In this example, the controller 100 executes a resistance detection sequence shown in FIG. 8A.

Furthermore, in this exemplary embodiment, the electrode roller 121 is provided with a cleaning mechanism 140.

In this example, the cleaning mechanism 140 has a cleaning member (e.g., cleaning blade) 141 that scrapes off a residue W of, for example, toner adhered on the electrode roller 121, and stores the residue W scraped off by the cleaning member 141 into a cleaning container 142.

Next, the resistance detection sequence of the second-transfer unit in this exemplary embodiment will be described.

Figure 8B:
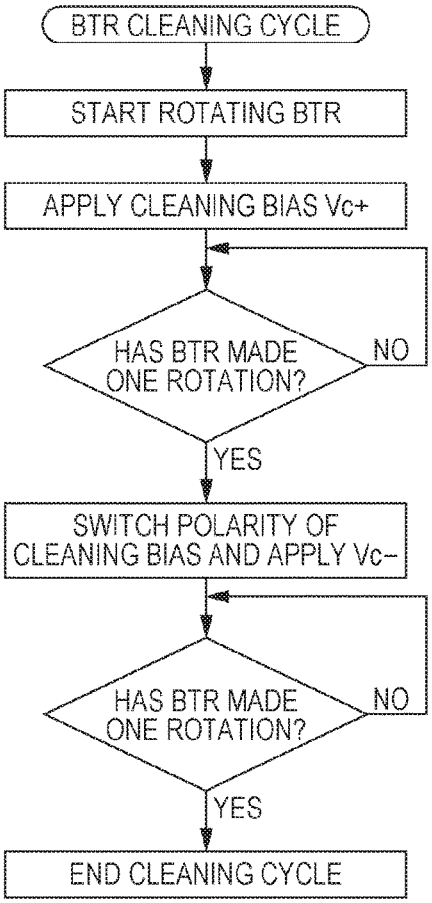
FIG. 8B is a flowchart illustrating an example of a bias-transfer-roller cleaning cycle in the resistance detection sequence shown in FIG. 8A.
Figure 9:
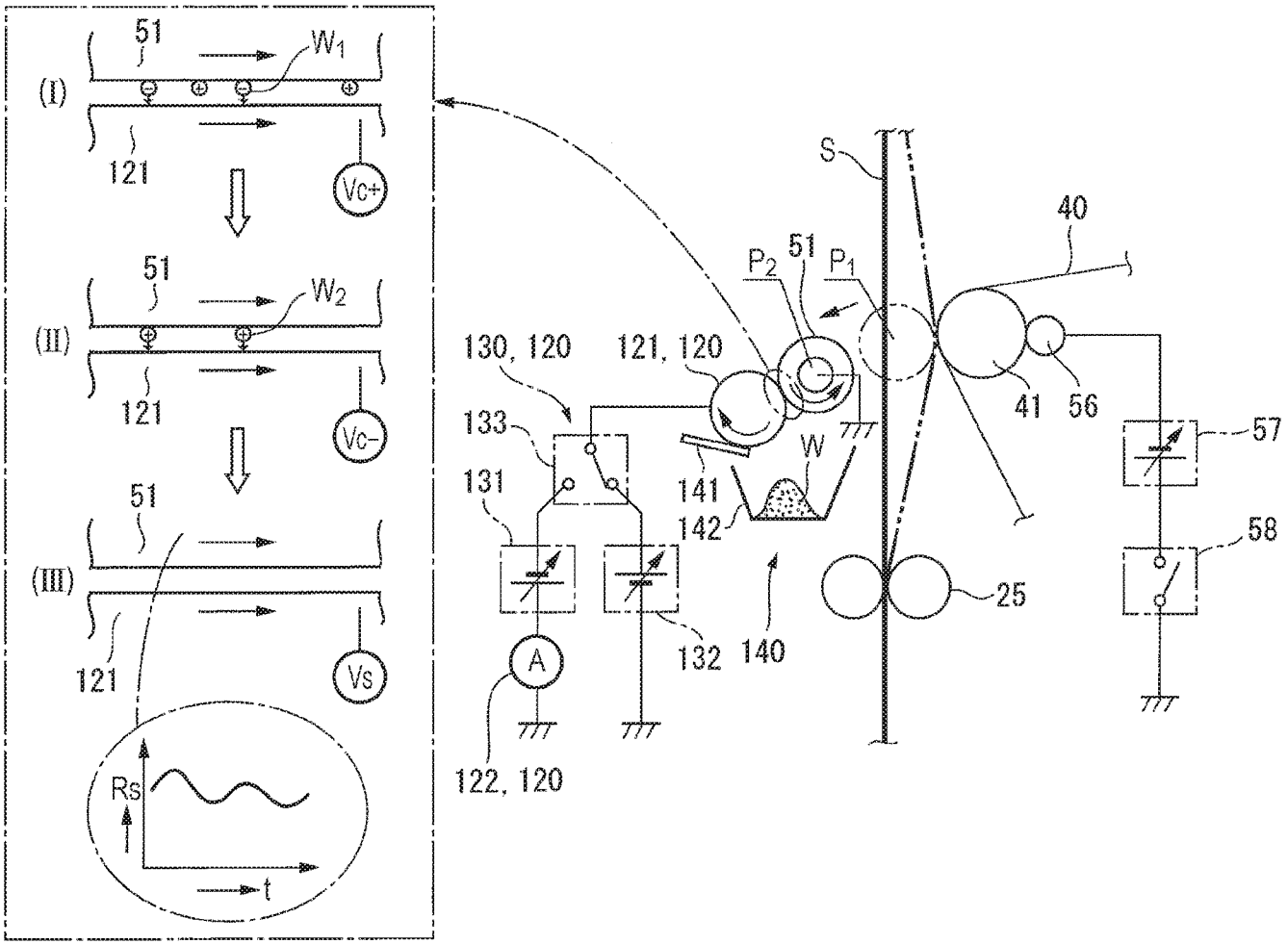
FIG. 9 schematically illustrates the resistance detection sequence of the second-transfer region of the image forming apparatus according to the second exemplary embodiment.

As shown in FIGS. 8A and 9, in this exemplary embodiment, the resistance detection sequence of the second-transfer unit involves feeding the continuous sheet S, stopping rotation of both the intermediate transfer member 40 and the second-transfer roller 51 (indicated as BTR (abbreviation of "bias transfer roller") in FIGS. 8A and 8B), and subsequently using the retracting mechanism 55 to cause the second-transfer roller 51 to retract to the retract position $P_2$, thereby bringing the second-transfer roller 51 into contact with the electrode roller 121.

Before a resistance detection cycle of the second-transfer roller 51 is to be executed in this state, a cleaning cycle of the second-transfer roller 51 is executed.

The cleaning cycle of the second-transfer roller 51 is intended to clean off the residue W, such as toner, adhered on the second-transfer roller 51. For example, in a case where an image-quality adjustment cycle is to be executed, a process for controlling the conditions of the image forming process is performed by preparing image-quality-adjustment patch images at the respective image forming sections 31 of the image forming engine 30, first-transferring the patch images onto the intermediate transfer member 40 from the photoconductors 32, and then detecting the density of each patch image by using a density detector (not shown). If the image-quality adjustment cycle of this kind is to be executed concurrently with the image forming process, the patch images have to be formed at locations outside the passing region of the continuous sheet S so as to prevent the patch images from being transferred onto the continuous sheet S in the second-transfer region. In this case, in the second-transfer region, the patch images on the intermediate transfer member 40 are directly transferred to the second-transfer roller 51 without the intervention of the continuous sheet S. In that case, the surface of the second-transfer roller 51 has to be cleaned.

As another example, a small amount of toner adhered to a background area (so-called fogging toner) transfers to and accumulates on the surface of the second-transfer roller 51 outside the passing region of a narrow continuous sheet S as a result of a continuous printing operation. When the continuous sheet S is subsequently replaced with a wide type, the toner retransfers to the back surface of the continuous sheet S from the surface of the second-transfer roller 51 and contaminates the continuous sheet S. In such a case, the surface of the second-transfer roller 51 has to be cleaned.

As shown in FIGS. 8B and 9, in this exemplary embodiment, the cleaning cycle of the second-transfer roller 51 involves rotating the second-transfer roller 51, selecting the positive-polarity power source 132 by using the switch 133 of the power supply unit 130, and applying the cleaning bias Vc+ to the electrode roller 121. In this state, for example, when the second-transfer roller 51 makes one rotation, the electrode roller 121 is rotationally slave-driven by the second-transfer roller 51, as shown in part (I) of FIG. 9, and a residue $W_1$ charged to the negative polarity (−), included in the residue W adhered on the surface of the second-transfer roller 51, receives a cleaning electric field according to the cleaning bias Vc+ so as to transfer toward the electrode roller 121.

Then, when the second-transfer roller 51 makes one rotation, the cleaning cycle involves selecting the negative-polarity power source 131 by using the switch 133 and applying the cleaning bias Vc− to the electrode roller 121. In this state, for example, when the second-transfer roller 51 makes one rotation, the electrode roller 121 is rotationally slave-driven by the second-transfer roller 51, as shown in part (II) of FIG. 9, and a residue $W_2$ charged to the positive polarity (+), included in the residue W adhered on the surface of the second-transfer roller 51, receives a cleaning electric field according to the cleaning bias Vc− so as to transfer toward the electrode roller 121. The sequential cleaning cycle ends at the point when the second-transfer roller 51 makes one rotation.

Because the electrode roller 121 is rotationally slave-driven by the second-transfer roller 51, the negative-polarity (−) residue $W_1$ and the positive-polarity (+) residue $W_2$ transferred to the electrode roller 121 are scraped off by the cleaning member 141 of the cleaning mechanism 140 as the electrode roller 121 rotates. Therefore, although the electrode roller 121 receives cleaning biases Vc having different polarities (Vc+ and Vc−), there is no concern that the residue W transferred to the electrode roller 121 may transfer back to the second-transfer roller 51.

When such a cleaning cycle is executed, the surface of the second-transfer roller 51 is cleaned.

Upon completion of the cleaning cycle, the resistance detection cycle of the second-transfer roller 51 is executed, as shown in FIG. 8A. The resistance detection cycle of the second-transfer roller 51 corresponds to the "start rotating BTR", "apply resistance-detection bias", and "detect current and calculate resistance" steps shown in FIG. 4A in the first exemplary embodiment.

Specifically, as shown in part (III) of FIG. 9, in this example, the second-transfer roller 51 is caused to make, for example, one rotation, the negative-polarity power source 131 is selected by using the switch 133, and the electrical-resistance-detection voltage Vs is applied to the electrode roller 121. In this state, the negative-polarity power source 131, the electrode roller 121, and the second-transfer roller 51 form a closed circuit. Therefore, the ampere meter 122 continuously detects a detection current flowing through the closed circuit, and the electrical resistance Rs of the second-transfer roller 51 is calculated based on this detection current.

Subsequently, as shown in FIG. 8A, substantially similar to the first exemplary embodiment, the controller 100 determines the transfer bias Vp, stops the operation for rotating the second-transfer roller 51 and the operation for applying the resistance-detection voltage Vs, moves the second-transfer roller 51 into pressure contact with the continuous sheet S at the contact position $P_1$, and ends the resistance detection sequence.

In particular, in this exemplary embodiment, the cleaning cycle of the second-transfer roller 51 is executed before the resistance detection cycle of the second-transfer roller 51 is executed, so that the following effects may be exhibited.

1. When the electrical resistance Rs of the second-transfer roller 51 is to be detected, there may be an extremely low concern that foreign matter, such as toner adhered on the surface of the second-transfer roller 51, may become a disturbance factor against the electrical resistance Rs.

2. There may be an extremely low concern that the back surface of the continuous sheet S may become contaminated due to the residue W of, for example, toner adhered on the second-transfer roller 51 retransferring onto the back surface of the continuous sheet S.

3. An increase in resistance of the second-transfer roller 51 over time may be suppressed since the residue W of, for example, toner adhered on the second-transfer roller 51 may be prevented from accumulating with time.

Third Exemplary Embodiment

Figure 10:
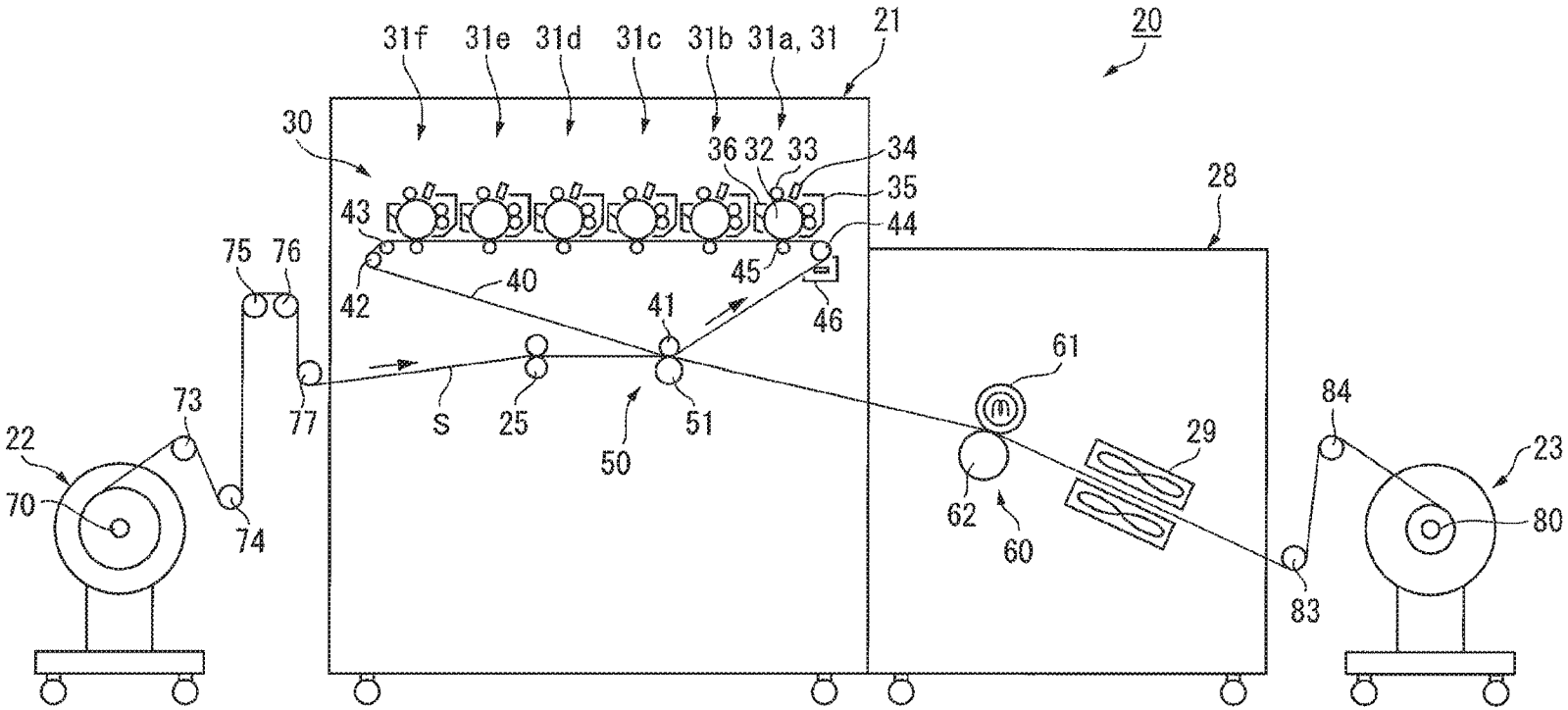
FIG. 10 illustrates the overall configuration of an image forming apparatus according to a third exemplary embodiment.

FIG. 10 illustrates the overall configuration of an image forming apparatus according to a third exemplary embodiment.

In FIG. 10, an image forming apparatus 20 is different from those in the first and second exemplary embodiments in that the image forming unit 21 containing the image forming engine 30 and a fixing unit 28 containing the fixing device 60 are juxtaposed to each other, the feeding unit 22 is disposed upstream of the image forming unit 21 in the transport direction of the continuous sheet S, and the collecting unit 23 is disposed downstream of the fixing unit 28 in the transport direction of the continuous sheet S. The image forming apparatus is not limited to this configuration. For example, the image forming unit 21 and the fixing unit 28 may be configured as a single device unit instead of being provided as separate units, and the image forming engine 30 and the fixing device 60 may be incorporated in the device unit. Moreover, a device that performs another process on the continuous sheet S may be additionally provided.

In this exemplary embodiment, multiple (six in this example) image forming sections 31 (e.g., 31*a* to 31*f*) are juxtaposed to one another above the intermediate transfer member 40, the second-transfer device 50 is disposed below the intermediate transfer member 40, and a transport path for the continuous sheet S extends horizontally within the image forming unit 21 and the fixing unit 28. The continuous sheet S fed from the feeding unit 22 is hooked around guide rollers 73 to 77 and is subsequently fed into the image forming unit 21. The collecting unit 23 hooks the continuous sheet S discharged from the fixing unit 28 around guide rollers 83 and 84 and subsequently winds the continuous sheet S around the winding roller 80. In FIG. 10, reference sign 29 denotes a cooling device that cools the continuous sheet S that has passed through the fixing device 60.

In particular, in this exemplary embodiment, the second-transfer device 50 is surrounded by components (not shown) that are capable of executing the resistance detection sequence of the second-transfer unit as described in the first and second exemplary embodiments. Moreover, the fixing device 60 includes a pair of fixing rollers 61 and 62 that are similar to those in the first and second exemplary embodiments and that move into and out of contact with each other.

Therefore, this exemplary embodiment is substantially similar to the first and second exemplary embodiments in that the resistance detection sequence of the second-transfer unit is executed, thereby optimizing the transfer condition of the second-transfer unit and eliminating wasteful transportation of the continuous sheet S.

First Example

A first example is achieved by realizing the resistance detection sequence of the second-transfer unit of the image forming apparatus according to the first exemplary embodiment. Specifically, while varying the installation environment of the apparatus, continuous printing is performed on 20,000 sheets' worth of continuous sheet S having a size equivalent to JIS A4-size in each environment. Then, the transfer bias Vp at the time of the transfer process and the electrical resistance Rs of the second-transfer roller 51 are measured to check for image-quality defects.

First Comparative Example

A first comparative example employs a method of controlling the transfer bias Vp of the second-transfer unit by using a temperature-humidity sensor within the image forming apparatus instead of detecting the resistance of the second-transfer roller 51 alone by using the electrode roller 121, unlike the detector 120 that detects the resistance of the second-transfer unit of the image forming apparatus according to the first example. Continuous printing is performed in a condition similar to that in the first example, and the transfer bias Vp at the time of the transfer process is measured to check for image-quality defects, similarly to the first example.

Figures 11A, 11B:
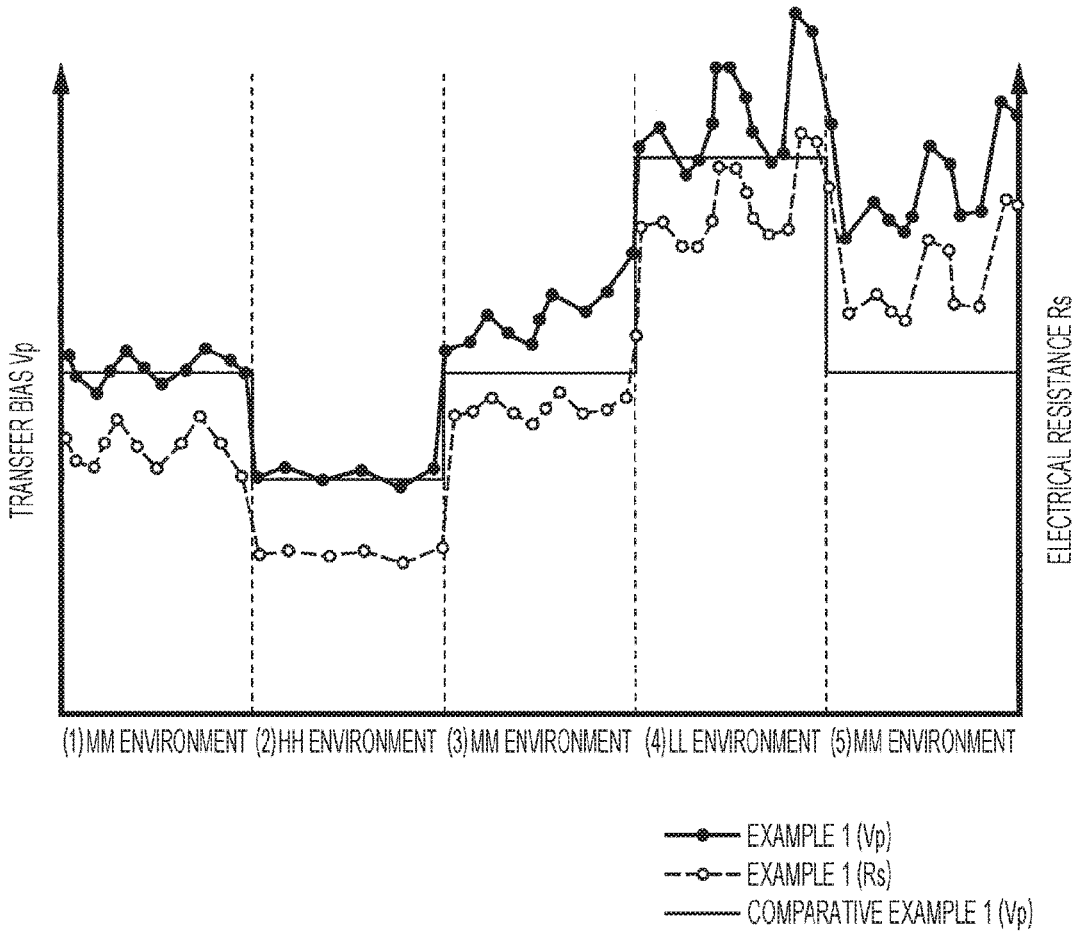
FIG. 11A illustrates a voltage change and a resistance change in a second-transfer region under each environmental condition of an image forming apparatus according to a first example and also illustrates a voltage change in a second-transfer region under each environmental condition of an image forming apparatus according to a first comparative example.
FIG. 11B illustrates image-quality evaluation results obtained under the individual environmental conditions of the image forming apparatuses according to the first example and the first comparative example.

The results obtained are shown in FIGS. 11A and 11B.

FIG. 11A illustrates changes in the transfer bias Vp and the electrical resistance Rs of the second-transfer roller obtained in accordance with the first example and measurement results of the transfer bias Vp obtained in accordance with the first comparative example in each environment by varying the installation environment of the apparatus in the following order (1) to (5).

In FIGS. 11A and 11B, the installation environments (1) to (5) are as follows.

(1) Mid-temperature mid-humidity (MM) environment (22° C./55%)

(2) High-temperature high-humidity (HH) environment (28° C./85%)

(3) Mid-temperature mid-humidity (4) Low-temperature low-humidity (10° C./15%)

(5) Mid-temperature mid-humidity

As shown in FIG. 11A, in the first example, it is clear that the transfer bias Vp is set to follow changes in the electrical resistance Rs of the second-transfer roller 51. Moreover, as shown in FIG. 11B, the image quality in the first example is satisfactory in all environments.

Furthermore, as shown in FIG. 11A, in the first comparative example, the transfer bias Vp deviates from an appropriate value (i.e., the transfer bias Vp in the first example) in the MM environment (3) to the MM environment (5), resulting in image-quality defects. In particular, the image-quality defects in the LL environment (4) and the MM environment (5) are noticeable.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit configured to transport a continuous recording medium;

an image bearing member configured to bear an image;

a transfer unit having a transfer member that is movable into and out of contact with the image bearing member, wherein the transfer unit is configured to transport the recording medium by nipping the recording medium between the image bearing member and the transfer member, and wherein the transfer unit is configured to transfer the image on the image bearing member onto the recording medium; and a detector configured to detect an electrical resistance of the transfer member in a state where the transfer member is disposed at a noncontact position located away from the image bearing member, wherein the transfer member is not in contact with the recording medium at the noncontact position.

2. The image forming apparatus according to claim 1, wherein the electrical resistance of the transfer member has a higher environmentally-dependent rate of change, as compared with electrical resistances of the image bearing member and the recording medium included in the transfer unit.

3. The image forming apparatus according to claim 1, wherein the detector is configured to detect the electrical resistance of the transfer member in a state where the transport unit is stopped.

4. The image forming apparatus according to claim 1, wherein the detector includes an electrode member that is disposed in contact with the transfer member when the electrical resistance of the transfer member is to be detected and that is capable of applying a voltage for detecting the electrical resistance of the transfer member.

5. The image forming apparatus according to claim 4, wherein the detector is configured to continuously detect the electrical resistance of the transfer member while the transfer member disposed in contact with the electrode member makes at least one rotation.

6. The image forming apparatus according to claim 4, wherein the electrode member is a rotatable roller.

7. The image forming apparatus according to claim 4, wherein the electrode member is configured to function as a cleaning member that applies a predetermined cleaning voltage so as to electrostatically attract foreign matter adhered on a surface of the transfer member.

8. The image forming apparatus according to claim 7, further comprising:

a cleaning member configured to scrape off foreign matter adhered on the electrode member.

9. The image forming apparatus according to claim 7, further comprising:

a cleaning-voltage power source capable of alternately applying cleaning voltages with different polarities to the electrode member every time the transfer member makes one rotation.

10. The image forming apparatus according to claim 1, wherein the transfer unit has a transfer power source capable of applying a transfer voltage to the transfer member, and wherein the detector is configured to apply an electrical-resistance-detection voltage to the transfer member by using the transfer power source when the electrical resistance of the transfer member is to be detected.

11. The image forming apparatus according to claim 1, further comprising:

a controller configured to determine a transfer condition of the transfer unit from a detection result of the detector, wherein the controller is configured to control an image forming operation performed on the recording medium.

12. An image forming apparatus comprising:

a transport unit configured to transport a continuous recording medium;

an image bearing member configured to bear an image;

a transfer unit having a transfer member that is movable into and out of contact with the image bearing member, wherein the transfer unit is configured to transport the recording medium by nipping the recording medium between the image bearing member and the transfer member, and wherein the transfer unit is configured to transfer the image on the image bearing member onto the recording medium; and a detector configured to detect an electrical resistance of the transfer member in a state where the transfer member is disposed at a noncontact position located away from the image bearing member, wherein the detector is configured to detect the electrical resistance of the transfer member in a state where the transport unit is stopped.

13. An image forming apparatus comprising:

a transport unit configured to transport a continuous recording medium;

an image bearing member configured to bear an image;

a transfer unit having a transfer member that is movable into and out of contact with the image bearing member, wherein the transfer unit is configured to transport the recording medium by nipping the recording medium between the image bearing member and the transfer member, and wherein the transfer unit is configured to transfer the image on the image bearing member onto the recording medium; and a detector configured to detect an electrical resistance of the transfer member in a state where the transfer member is disposed at a noncontact position located away from the image bearing member, wherein the detector includes an electrode member that is disposed in contact with the transfer member when the electrical resistance of the transfer member is to be detected and that is capable of applying a voltage for detecting the electrical resistance of the transfer member.

* * * * *